US007641303B2

(12) United States Patent
Andrews

(10) Patent No.: US 7,641,303 B2
(45) Date of Patent: Jan. 5, 2010

(54) DROP EMITTING APPARATUS

(75) Inventor: John R. Andrews, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/145,103

(22) Filed: Jun. 24, 2008

(65) Prior Publication Data

US 2008/0259127 A1 Oct. 23, 2008

Related U.S. Application Data

(63) Continuation of application No. 10/990,229, filed on Nov. 15, 2004, now Pat. No. 7,399,050.

(51) Int. Cl.
*B41J 2/015* (2006.01)

(52) U.S. Cl. ..... 347/20; 347/62; 347/68; 347/94

(58) Field of Classification Search ..... 347/20, 347/54, 56, 61–65, 67–71, 92–94, 55
See application file for complete search history.

(56) References Cited

U.S. PATENT DOCUMENTS 4,418,355 A * 11/1983 DeYoung et al. ..... 347/70
4,630,072 A 12/1986 Scardovi et al. ..... 347/94
5,943,079 A 8/1999 Yoshida ..... 347/94
6,592,216 B2 7/2003 Slenes et al. ..... 347/94
2003/0063171 A1 4/2003 Otsuka et al. ..... 347/194

FOREIGN PATENT DOCUMENTS

EP 1466735 10/2004

OTHER PUBLICATIONS

David Jones; Handbook of Viscoelastic Vibration Damping; 2001; Table of Contents and pp. 11-13, 40, 63-66, 155-156, 158-160, 164, 185-187.

Roderic Lakes; Viscoelastic Solids; 1998; Table of Contents and pp. 82-83, 88, 90-94, 243-247, 250-251.

European Search Report and Annex to the European Search Report for European Application No. EP 05256930, May 14, 2007.

* cited by examiner

*Primary Examiner*—Juanita D Stephens
(74) *Attorney, Agent, or Firm*—Marger Johnson & McCollom, P.C.

(57) ABSTRACT

A drop emitting apparatus including a manifold, a viscoelastic structure acoustically coupled to the manifold, and a plurality of drop generators fluidically coupled to the manifold.

16 Claims, 3 Drawing Sheets

DROP EMITTING APPARATUS

This application is a continuation of, and claims priority to, U.S. application Ser. No. 10/990,229 filed Nov. 15, 2004, now U.S. Pat. No. 7,399,050.

BACKGROUND

The disclosure relates generally to drop emitting apparatus including for example drop jetting devices.

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper.

It can be difficult to control drop mass/volume and/or drop velocity in drop emitting apparatus such as ink jet printers.

DETAILED DESCRIPTION

Figure 1:
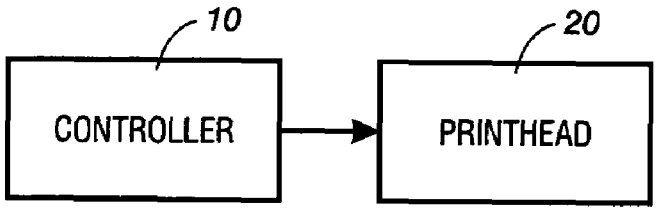
FIG. 1 is a schematic block diagram of an embodiment of a drop-on-demand drop emitting apparatus.

FIG. 1 is schematic block diagram of an embodiment of a drop-on-demand printing apparatus that includes a controller 10 and a printhead assembly 20 that can include a plurality of drop emitting drop generators. The controller 10 selectively energizes the drop generators by providing a respective drive signal to each drop generator. Each of the drop generators can employ a piezoelectric transducer. As other examples, each of the drop generators can employ a shear-mode transducer, an annular constrictive transducer, an electrostrictive transducer, an electromagnetic transducer, or a magnetorestrictive transducer. The printhead assembly 20 can be formed of a stack of laminated sheets or plates, such as of stainless steel.

Figure 2:
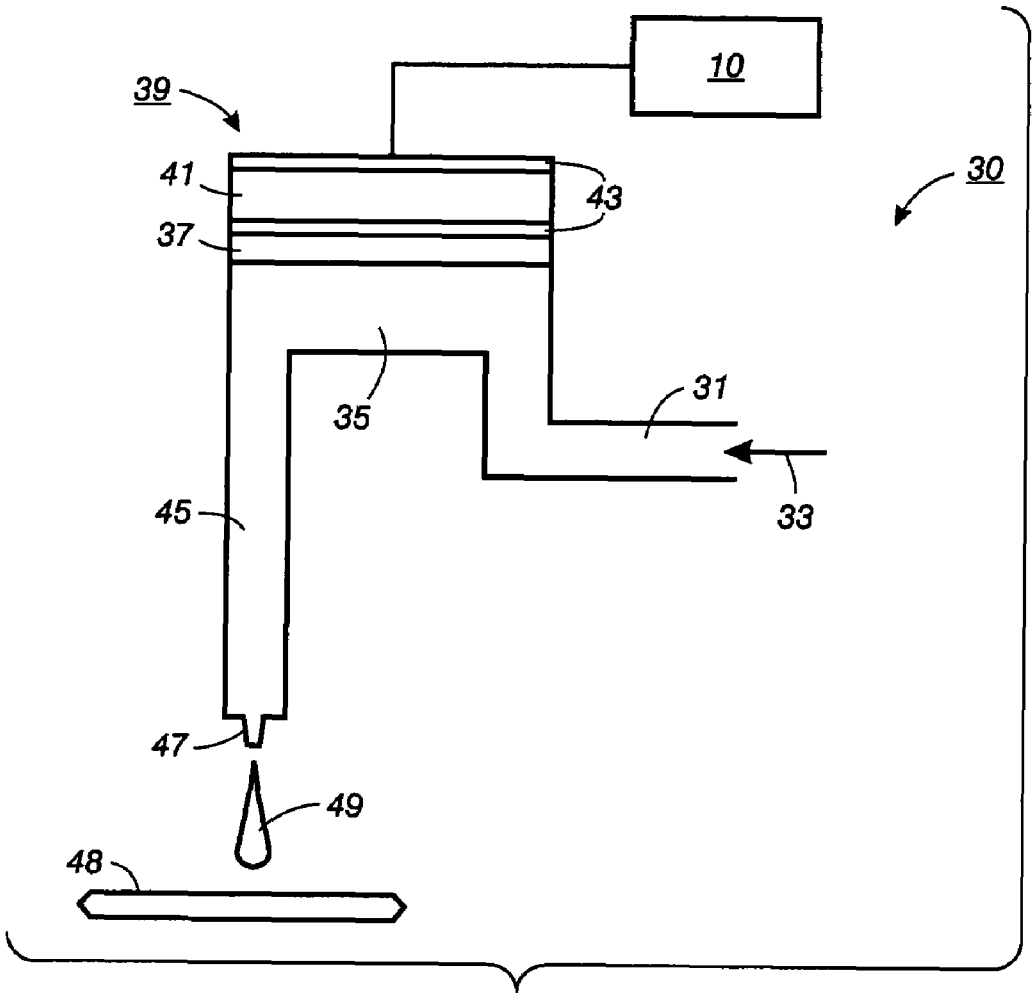
FIG. 2 is a schematic block diagram of an embodiment of a drop generator that can be employed in the drop emitting apparatus of FIG. 1.

FIG. 2 is a schematic block diagram of an embodiment of a drop generator 30 that can be employed in the printhead assembly 20 of the printing apparatus shown in FIG. 1. The drop generator 30 includes an inlet channel 31 that receives ink 33, for example from an ink containing manifold. The ink 33 flows into an ink pressure or pump chamber 35 that is bounded on one side, for example, by a flexible diaphragm 37. An electromechanical transducer 39 is attached to the flexible diaphragm 37 and can overlie the pressure chamber 35, for example. The electromechanical transducer 39 can be a piezoelectric transducer that includes a piezo element 41 disposed for example between electrodes 43 that receive drop firing and non-firing signals from the controller 10. Actuation of the electromechanical transducer 39 causes ink to flow from the pressure chamber 35 through an outlet channel 45 to a drop forming nozzle or orifice 47, from which an ink drop 49 is emitted toward a receiver medium 48 that can be a transfer surface, for example.

The ink 33 can be melted or phase changed solid ink, and the electromechanical transducer 39 can be a piezoelectric transducer that is operated in a bending mode, for example.

Figure 3:
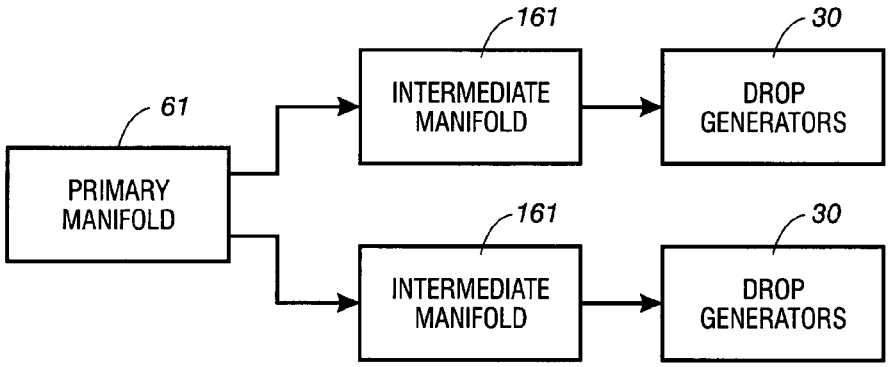
FIG. 3 is a schematic block diagram of an embodiment of fluidic architecture of a drop emitting apparatus.

FIG. 3 is a block diagram of an embodiment of a fluidic structure that can be employed in the printhead assembly 20 (FIG. 1). The fluidic structure includes a primary manifold 61 that receives ink 33 from an ink supply such as an ink reservoir or tank. The primary manifold 61 is fluidically coupled to a plurality of intermediate manifolds 161, each of which is fluidically coupled to a plurality of drop generators 30. Alternatively, the intermediate manifolds 161 can be omitted such that the drop generators 30 can be more directly fluidically coupled to the primary manifold 61.

Figure 4:
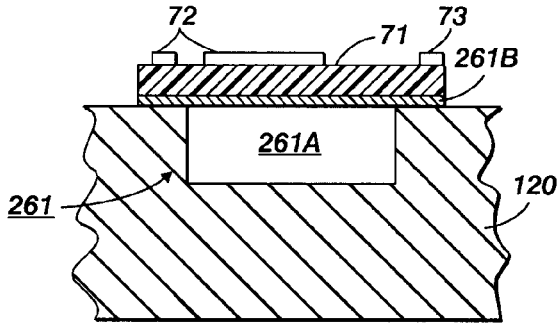
FIG. 4 is a schematic depiction of an embodiment of a manifold structure that can be employed in a drop emitting apparatus.

FIG. 4 is a schematic block diagram of an embodiment of a manifold 261 that can be employed as any one of the manifolds of the manifold structure of FIG. 3. The manifold 261 comprises a manifold cavity 261A formed in a substrate 120, a compliant wall 261B forming a wall of the manifold, and a viscoelastic layer 71 attached to the compliant wall 261B. The viscoelastic layer 71 can be on an outside surface of the compliant wall 261B or on the inside surface of the compliant wall 261B, depending upon the particular application. The viscoelastic layer 71 can comprise a viscoelastic solid or a viscoelastic foam. The viscoelastic foam can be injected, for example in an implementation wherein the compliant wall 261B is internal to the substrate 120 in which the manifold 261 is formed, or wherein the compliant wall 261B is otherwise enclosed. The viscoelastic layer 71 can also comprise a viscoelastic circuit board such as viscoelastic flexible circuit board, supporting circuit 72. The viscoelastic layer 71 can further comprise a viscoelastic substrate, such as a viscoelastic flexible substrate, and a heater 73 supported by the viscoelastic substrate. Still further, the viscoelastic layer 71 can comprise a viscoelastic circuit board/heater structure. The compliant wall 261B can be an elastic compliant wall, and can comprise for example stainless steel or a viscoelastic material.

Figure 5:
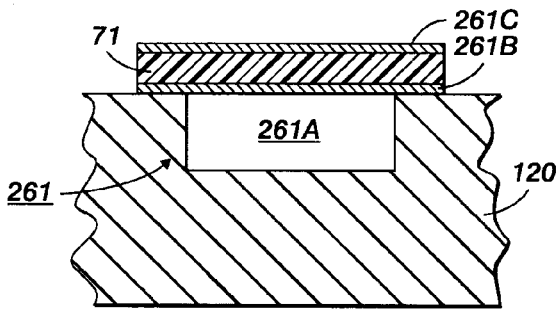
FIG. 5 is a schematic depiction of an embodiment of another manifold structure that can be employed in a drop emitting apparatus.

FIG. 5 is a schematic block diagram of an embodiment of a further manifold 261 that can be employed as any one of the manifolds of the manifold structure of FIG. 3. The manifold 261 comprises a manifold cavity 261A formed in a substrate 120, a compliant wall 261B forming a wall of the manifold, a wall 261C separated from the compliant wall 261B, and a viscoelastic layer 71 laminarly disposed between the compliant wall 261B and the wall 261C which can comprise a compliant wall. The compliant wall 261B can be an elastic compliant wall and can comprise stainless steel or a viscoelastic material. The wall 261C can also comprise a stainless steel or a viscoelastic material, for example. The viscoelastic layer 71 can comprise a viscoelastic solid or a viscoelastic foam. The viscoelastic layer 71 can also comprise a viscoelastic circuit board such as a viscoelastic flexible circuit. The viscoelastic layer 71 can further comprise a viscoelastic substrate, such as a viscoelastic flexible substrate, and a heater supported by the viscoelastic substrate. Still further, the viscoelastic layer 71 can comprise a viscoelastic circuit board/heater structure.

Figure 6:
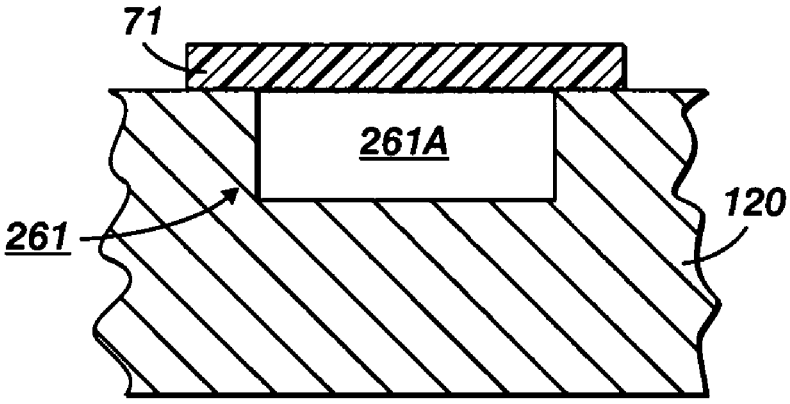
FIG. 6 is a schematic depiction of an embodiment of a further manifold structure that can be employed in a drop emitting apparatus.

FIG. 6 is a schematic block diagram of an embodiment of another manifold 261 that can be employed as any one of the manifolds of the manifold structure of FIG. 3. The manifold 261 comprises a manifold cavity 261A formed in a substrate 120 and a viscoelastic compliant wall 71 forming a compliant wall of the manifold. The viscoelastic wall 71 comprises a viscoelastic material, and can be implemented without a separate compliant wall attached thereto. By way of illustrative example, the viscoelastic wall 71 can comprise a viscoelastic circuit board such as viscoelastic flexible circuit board. The viscoelastic compliant wall 71 can further comprise a viscoelastic substrate, such as a viscoelastic flexible substrate, and a heater supported by the viscoelastic substrate. Still further, the viscoelastic compliant wall 71 can comprise a viscoelastic circuit board/heater structure.

The substrate 120 in which the manifold 261 is implemented can comprise for example a laminar stack of bonded metal plates such as stainless steel. As another example, the substrate 120 can comprise a viscoelastic material.

In general, the disclosed drop generator includes a viscoelastic structure that is acoustically coupled to a manifold and can comprise, for example, a wall of the manifold or a viscoelastic layer attached to a compliant wall that forms a wall, or a portion of a wall, of the manifold. The viscoelastic structure can provide acoustic damping or attenuation over one or more predetermined frequency ranges. The viscoelastic structure can provide acoustic attenuation over a frequency range that includes frequencies that could otherwise cause image banding, for example a frequency range of about 0.5 kHz to about 5 kHz. As another example, the viscoelastic structure can provide acoustic attenuation over a frequency range that includes frequencies that can cause density noise in the image, for example a frequency range of about 5 kHz to about 45 kHz. Also, the viscoelastic structure can provide acoustic attenuation over a frequency range that includes the drop firing frequency.

By way of illustrative example, the viscoelastic structure of the manifold 261 comprises an elastomer, adhesive, or plastic material that is directly in contact with the manifold, or an elastomer, adhesive or plastic material in contact with a compliant element that forms a wall, or portion of a wall of the manifold.

A wide range of materials, including polymers, having viscoelastic properties can be employed in the viscoelastic structures. Specific examples include acrylic rubber, butyl rubber, nitrile rubber, natural rubber, fluorosilicone rubber, fluorocarbon rubber, polyethylene, polymethyl methacralate silicone rubber, polyimide, polyether sulphone, polyetherimide, polytetrafluoroethylene, polyesters, polyethylene naphthalene, acrylic adhesives, silicone adhesives, epoxy adhesives, phenolic adhesives, acrylic-epoxy blends and phenolic adhesives blended with nitrile rubbers.

By way of further illustrative example, the viscoelastic structure comprises material having loss factor that is greater than about 0.01. As another example, the viscoelastic structure can have a loss factor that is greater than about 1.0 or 1.5. The viscoelastic structure can also have a loss factor that is greater than about 2.0.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A drop emitting apparatus comprising:

a fluid manifold having at least one wall made of a viscoelastic material, the wall being in contact with fluid on the manifold side and at least in part in contact with air on the side opposite the fluid to allow the wall to attenuate acoustic energy, wherein the viscoelastic wall further comprises a heater; and a plurality of drop generators fluidically coupled to the manifold.

2. The drop emitting apparatus of claim 1 wherein the viscoelastic material comprises an elastomer, adhesive or plastic material.

3. The drop emitting apparatus of claim 1 wherein the viscoelastic material is selected from the group consisting of acrylic rubber, butyl rubber, nitrile rubber, natural rubber, fluorosilicone rubber, fluorocarbon rubber, polyethylene, polymethyl methacralate silicone rubber, polyimide, polyether sulphone, polyetherimide, polytetrafluoroethylene, polyesters, polyethylene naphthalene.

4. The drop emitting apparatus of claim 3 in which the wall is comprised of a multilayer material having one layer being of the viscoelastic material, and the other layer being an adhesive layer consisting at least one of the adhesives: acrylic adhesives, silicone adhesives, epoxy adhesives, phenolic adhesives, acrylic-epoxy blends, thermoplastic polyimide adhesive, and phenolic adhesives blended with nitrile rubbers.

5. The drop emitting apparatus of claim 3 in which the wall is comprised of a multilayer material having one layer being of the viscoelastic material, and the other layer being an adhesive layer consisting at least one of the adhesives: acrylic adhesives, silicone adhesives, epoxy adhesives, phenolic adhesives, acrylic-epoxy blends, thermoplastic polyimide adhesive, and phenolic adhesives blended with nitrile rubbers.

6. The drop emitting apparatus of claim 1 in which the wall comprises a structure having a first surface layer consisting of a first adhesive, a second surface layer consisting of a second adhesive, and a core layer which selected from the group consisting of acrylic rubber, butyl rubber, nitrile rubber, natural rubber, fluorosilicone rubber, fluorocarbon rubber, polyethylene, polymethyl methacralate silicone rubber, polyimide, polyether sulphone, polyetherimide, polytetrafluoroethylene, polyesters, polyethylene naphthalene and the first and second adhesives are selected from the group consisting of acrylic adhesives, silicone adhesives, epoxy adhesives, phenolic adhesives, acrylic-epoxy blends, thermoplastic polyimide adhesive, and phenolic adhesives blended with nitrile rubbers.

7. The drop emitting apparatus of claim 6 in which the viscoelastic wall is bonded to form a manifold wall on one side and bonded to a second layer on the opposite side in which the second layer does not constrain the viscoelastic layer over at least part of the manifold.

8. The drop emitting apparatus of claim 7 in which the multilayer viscoelastic layer is bonded to form a manifold wall on one side and bonded to a second layer on the opposite side in which the second layer is unconstrained.

9. The drop emitting apparatus of claim 7 in which the multilayer viscoelastic layer is bonded to form a manifold wall on one side and bonded to a second layer on the opposite side in which the second layer is unconstrained.

10. The drop emitting apparatus of claim 6 in which the viscoelastic wall is bonded to form a manifold wall on one side and bonded to a second layer on the opposite side in which the second layer does not constrain the viscoelastic layer over at least part of the manifold.

11. The drop emitting apparatus of claim 1, wherein the viscoelastic wall further includes a circuit on the wall.

12. The drop emitting apparatus of claim 1 wherein the viscoelastic material comprises an elastomer, adhesive or plastic material.

13. The drop emitting apparatus of claim 1 wherein the viscoelastic material is selected from the group consisting of acrylic rubber, butyl rubber, nitrile rubber, natural rubber, fluorosilicone rubber, fluorocarbon rubber, polyethylene, polymethyl methacralate silicone rubber, polyimide, polyether sulphone, polyetherimide, polytetrafluoroethylene, polyesters, polyethylene naphthalene.

14. The drop emitting apparatus of claim 1 in which the wall comprises a structure having a first surface layer consisting of a first adhesive, a second surface layer consisting of a second adhesive, and a core layer which selected from the group consisting of acrylic rubber, butyl rubber, nitrile rubber, natural rubber, fluorosilicone rubber, fluorocarbon rubber, polyethylene, polymethyl methacralate silicone rubber, polyimide, polyether sulphone, polyetherimide, polytetrafluoroethylene, polyesters, polyethylene naphthalene and the first and second adhesives are selected from the group consisting of acrylic adhesives, silicone adhesives, epoxy adhesives, phenolic adhesives, acrylic-epoxy blends, thermoplastic polyimide adhesive, and phenolic adhesives blended with nitrile rubbers.

15. A drop emitting apparatus comprising:

a fluid manifold having at least one wall made of a viscoelastic material, the wall being in contact with fluid on the manifold side and at least in part in contact with air on the side opposite the fluid to allow the wall to attenuate acoustic energy, wherein the viscoelastic wall further includes a circuit on the wall; and a plurality of drop generators fluidically coupled to the manifold.

16. The drop emitting apparatus of claim 15, wherein the viscoelastic wall further comprises a heater.

* * * * *